US012435588B2

(12) United States Patent
Liu et al.

(10) Patent No.: US 12,435,588 B2
(45) Date of Patent: Oct. 7, 2025

(54) RAPID ASSEMBLY AND AUTOMATIC SAMPLING DRILLING TOOL FOR FROZEN SOIL LAYER EXPLORATION

(71) Applicant: POWERCHINA HUADONG ENGINEERING CORPORATION LIMITED, Zhejiang (CN)

(72) Inventors: An Liu, Zhejiang (CN); Zhigang Shan, Zhejiang (CN); Jian Wang, Zhejiang (CN); Peng Peng, Zhejiang (CN); Kun Zhang, Zhejiang (CN); Weida Ni, Zhejiang (CN); Meifeng Niu, Zhejiang (CN)

(73) Assignee: POWERCHINA HUADONG ENGINEERING CORPORATION LIMITED, Zhejiang (CN)

( * ) Notice: Subject to any disclaimer, the term of this patent is extended or adjusted under 35 U.S.C. 154(b) by 0 days.

(21) Appl. No.: 18/856,461

(22) PCT Filed: May 17, 2023

(86) PCT No.: PCT/CN2023/094710
§ 371 (c)(1),
(2) Date: Oct. 11, 2024

(87) PCT Pub. No.: WO2023/246382
PCT Pub. Date: Dec. 28, 2023

(65) Prior Publication Data

US 2025/0257624 A1 Aug. 14, 2025

(30) Foreign Application Priority Data

Jun. 22, 2022 (CN) ..... 202210709330.2

(51) Int. Cl.
*E21B 10/02* (2006.01)
*E21B 10/60* (2006.01)
(Continued)

(52) U.S. Cl.
CPC ..... *E21B 25/10* (2013.01); *E21B 10/605* (2013.01); *E21B 49/02* (2013.01)

(58) Field of Classification Search
CPC ..... E21B 7/008; E21B 10/02; E21B 10/04; E21B 10/605; E21B 10/48
See application file for complete search history.

(56) References Cited

U.S. PATENT DOCUMENTS 3,323,604 A * 6/1967 Henderson ..... E21B 10/04 175/215
2019/0048674 A1* 2/2019 Galinsky ..... B28D 1/041

FOREIGN PATENT DOCUMENTS

CN 106014202 A 10/2016
CN 205823157 U 12/2016
(Continued)

*Primary Examiner* — Kipp C Wallace
(74) *Attorney, Agent, or Firm* — MUNCY, GEISSLER, OLDS & LOWE, P.C.

(57) ABSTRACT

A rapid assembly and automatic sampling drilling tool for frozen soil layer exploration includes a fixed flow divider, a flow guide pipe, a coring pipe and a drill bit. The fixed flow divider is connected to the drill bit through the flow guide pipe and the coring pipe mounted between the fixed flow divider and the drill bit. Two ends of the flow guide pipe communicate with the fixed flow divider and a main flow channel in the drill bit respectively. Hot water in the fixed flow divider can be conveyed into the drill bit through the flow guide pipe and sprayed from a nozzle arranged on the drill bit for drilling and coring operations. An inlet of the coring pipe communicates with a coring channel in an inner cavity in the drill bit, and a core sample drilled by the drill bit is taken out through the coring pipe.

3 Claims, 3 Drawing Sheets

(51) Int. Cl.
*E21B 25/10* (2006.01)
*E21B 49/02* (2006.01)

(56) References Cited

FOREIGN PATENT DOCUMENTS

| | | | | | | |
|---|---|---|---|---|---|---|
| CN | 106907106 | A | | 6/2017 | | |
| CN | 109025810 | A | | 12/2018 | | |
| CN | 208330186 | U | * | 1/2019 | ..... | E21B 25/00 |
| CN | 111255375 | A | * | 6/2020 | ..... | E21B 7/008 |
| CN | 114215489 | A | * | 3/2022 | | |
| CN | 114991674 | A | | 9/2022 | | |
| DE | 202004019168 | U1 | | 5/2005 | | |

* cited by examiner

RAPID ASSEMBLY AND AUTOMATIC SAMPLING DRILLING TOOL FOR FROZEN SOIL LAYER EXPLORATION

FIELD OF THE INVENTION

The present invention relates to an automatic sampling drilling tool, particularly to a rapid assembly and automatic sampling drilling tool for frozen soil layer exploration.

BACKGROUND OF THE INVENTION

Presently, with the rapid development of economy, the construction of various major projects has gradually expanded from the mainland region to plateau and high-cold regions. It is very challenging to carry out preliminary exploration work in such extreme environments; the reason is that the permafrost formed in a low-temperature environment has extremely special engineering geological properties, and its physical and mechanical properties are different from those of ordinary soil layers. In addition, the active layer in the permafrost area freezes and melts seasonally every year. One of the main means of permafrost exploration is to obtain permafrost samples by drilling. The current conventional drilling method is to break core samples using the breaker inside the drill bit after completion of drilling, and then pull the samples to the earth surface together with the drilling tool. When this method is used, the friction generated by the rotation of the drill bit increases the temperature of the breaker, and the higher temperature of the breaker melts part of the permafrost layer, which makes the core breaking function of the breaker to become ineffective and results in the failure to acquire some core samples during drilling. Another drilling method is the hot water drilling method in ice drilling, which uses the jetted hot water to melt the frozen soil layer to complete the drilling; the method has the characteristics of no drilling fluid pollution and rapid drilling, etc. It can complete coring from the frozen soil layer at certain specific depths, and there is no need of coring from all of them. Therefore, it is more efficient and convenient in application. Based on this method, a rapid assembly and automatic sampling drilling tool is designed, which can effectively solve the problems of failure of the function of a breaker in a rotary drilling method and difficulty in recovering ice cores on the earth surface in a thermal melt drilling method, etc., improve the drilling efficiency of frozen soil layers greatly, and further improve the exploration technology of frozen soil layers.

SUMMARY OF THE INVENTION

An object of the present invention is to provide a rapid assembly and automatic sampling drilling tool for frozen soil layer exploration, to effectively solve a plurality of problems such as a failure of the function of a breaker in a rotary drilling method and difficulty in recovering ice cores on the earth surface in a thermal melt drilling method.

The rapid assembly and automatic sampling drilling tool for frozen soil layer exploration provided in the present invention includes a fixed flow divider, a flow guide pipe, a coring pipe and a drill bit. The fixed flow divider is connected to the drill bit through the flow guide pipe and the coring pipe, the flow guide pipe and the coring pipe are mounted between the fixed flow divider and the drill bit, two ends of the flow guide pipe are in communication with the fixed flow divider and a main flow channel in the drill bit respectively, hot water in the fixed flow divider can be conveyed into the drill bit through the flow guide pipe and sprayed from a nozzle arranged on the drill bit for drilling and coring operations, an inlet of the coring pipe is in communication with a coring channel in an inner cavity in the middle of the drill bit, and a core sample drilled by the drill bit is taken out through the coring pipe.

The coring pipe is a plexiglass pipe, four flow guide pipes are provided, and the four flow guide pipes are arranged around the coring pipe, the flow guide pipes are connected to the drill bit by a quick connector, and the flow guide pipes and the drill bit can be quickly disassembled through the quick connector, and a breaker is mounted at a junction between the drill bit and the inlet of the coring pipe for breaking the core sample drilled by the drill bit.

The drill bit is a ring structure, the drill bit is composed of an inner ring and an outer ring, the outer ring is sleeved on the lower part of the inner ring, the top of the inner ring is equipped with a male end of the quick connector, and the top of the inner ring can be fixedly connected with a female end of the quick connector assembled at the bottom of the flow guide pipe through the male end of the quick connector, a plurality of connecting ear plates are arranged around the lower part of the inner ring, positioning bolts are arranged on the connecting ear plates in a penetrating manner, the inner ring is connected to the outer ring through the positioning bolts, a reset spring is sleeved on the positioning bolts below the connecting ear plates, and the outer ring can move along the axial direction of the positioning bolts as the reset spring extends and retracts.

Both the inner ring and the outer ring are hollow structures, the inner cavities of the outer ring and the inner ring are set as coring channels, a circulation channel is formed between the outer wall and the bottom of the inner ring and the inner wall and the bottom of the outer ring, a vertical main flow channel is formed in the side wall of the inner ring, an inlet at the upper end of the main flow channel is in communication with an outlet of the flow guide pipe, the main flow channel is used as a passage of hot water in the fixed flow divider, an outlet at the bottom of the main flow channel is in communication with the circulation channel formed between the inner ring and the outer ring, a water supply nozzle is provided on the side wall of the main flow channel corresponding to the inner cavity of the inner ring, and two ends of the water supply nozzle are in communication with the main flow channel and the circulation channel respectively, a first seal ring is mounted on the upper part of the water supply nozzle in the circulation channel, a second seal ring and a third seal ring are mounted sequentially on the lower part of the water supply nozzle in the circulation channel, a plurality of coring nozzles are provided around the side wall of the outer ring between the first seal ring and the third seal ring, and the coring nozzles can be in communication with the water supply nozzle through the circulation channel, a fourth seal ring is mounted in the other side of the circulation channel corresponding to the third seal ring, a drilling nozzle is provided at the bottom of the outer ring, a fifth seal ring is mounted at the bottom of the inner ring, and the fifth seal ring is arranged corresponding to the drilling nozzle, when the outer ring moves to the farthest end for drilling operation under the action of gravity and the tension of the reset spring, the first seal ring, the second seal ring, the third seal ring and the fourth seal ring seal the passage between the water supply nozzle and the coring nozzle and the main flow channel and the circulation channel respectively so that the hot water in the main flow channel is sprayed through the drilling nozzle for drilling operation; when coring to the set position, the outer ring moves up and fits tightly against the bottom of the inner ring, the first seal ring, the second seal ring, the third seal ring and the fourth seal ring seal the circulation channel, the fifth seal ring seals the drilling nozzle, the water supply nozzle is in communication with the coring nozzle through the circulation channel, and the hot water in the main flow channel is sprayed through the coring nozzle for coring operation.

The fixed flow divider, the quick connector and the breaker are all assemblies of existing equipment, so the specific models and specifications are not described in detail.

The working principle of the present invention is as follows:

When the rapid assembly and automatic sampling drilling tool for frozen soil layer exploration provided by the present invention starts drilling, the drilling tool is lowered vertically to the borehole, and the outer ring of the drill bit moves to the farthest end under the action of gravity and the tension of the reset spring to form a drilling state. In this state, hot water enters from the inlet of the fixed flow divider, flows through the flow guide pipe, and then merges in the main flow channel in the side wall of the inner ring of the drill bit. At this time, the first seal ring and the second seal ring seal the water flow channel of the water supply nozzle, the third seal ring seals the water flow channel of the coring nozzle, and the fourth seal ring seals the circulation channel between the inner ring and the outer ring; hot water is sprayed from the drilling nozzle at the bottom of the outer ring to melt the frozen soil layer for drilling, and the formed core samples enter the coring pipe.

As drilling progresses, the coring pipe is filled with core samples gradually; at this time, the drill bit is lowered continuously, and the outer ring of the drill bit begins to contact the bottom of the borehole. Under the thrust of the frozen soil layer at the bottom of the borehole, the outer ring overcomes gravity and the tension of the reset spring; the outer ring moves upward to be close to the bottom of the inner ring, forming a coring state. In this state, the water supply nozzle formed on the side wall of the inner ring is in communication with the coring nozzle formed on the side wall of the outer ring through the circulation channel. The first seal ring, the second seal ring, the third seal ring and the fourth seal ring seal the circulation channel between the inner ring and the outer ring, and the fifth seal ring seals the drilling nozzle at the bottom of the outer ring. At this time, hot water can flow from the water supply nozzle on the side wall of the inner ring into the coring nozzle on the side wall of the outer ring, which is sprayed to melt the core samples radially until the core samples are melted off.

After the core samples are melted off, the drilling tool is pulled up; core samples are supported by the breaker on the drill bit and moved to the earth surface along with the drilling tool; at this time, the quick connector is manually opened, the drill bit can be quickly removed, the coring pipe containing the core samples is pulled out, and the core samples are recovered, and one round of drilling is completed. The coring pipe is cleaned and placed in the space surrounded by the flow guide pipe. Then the male and female ends of the quick connector are closed, the drill bit is connected with the flow guide pipe, and the coring pipe is fixed again to start the second drilling.

Beneficial Effects of the Present Invention

The rapid assembly and automatic sampling drilling tool for frozen soil layer exploration provided by the invention has a unique structural design and definite principle, and effectively solves a plurality of problems such as a failure of the function of a breaker in a rotary drilling method and difficulty in recovering ice cores on the earth surface in a thermal melt drilling method; furthermore, it can automatically change the internal water flow channel to melt the ice cores during drilling, and quickly disassemble to obtain core samples after completion of drilling, greatly improving the efficiency of drilling and auxiliary operations and effectively saving resources.

Figure 1:
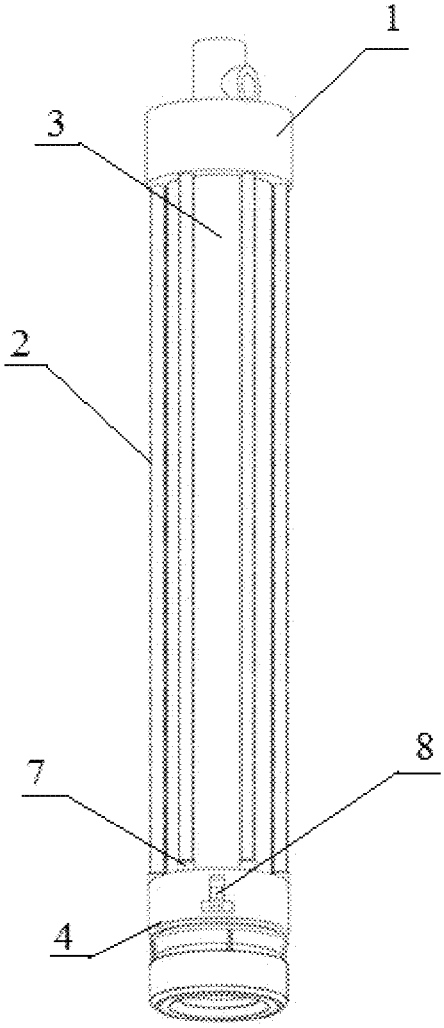
FIG. 1 is an overall structural view of a drilling tool of the present invention.

Reference numerals: 1, fixed flow divider, 2, flow guide pipe, 3, coring pipe, 4, drill bit, 5, main flow channel, 6, coring channel, 7, quick connector, 8, breaker, 9, inner ring, 10, outer ring, 11, connecting ear plate, 12, positioning bolt, 13, reset spring, 14, circulation channel, 15, water supply nozzle, 16, first seal ring, 17, second seal ring, 18, third seal ring, 19, coring nozzle, 20, fourth seal ring, 21, drilling nozzle, 22, fifth seal ring.

DETAILED DESCRIPTION

Figure 2:
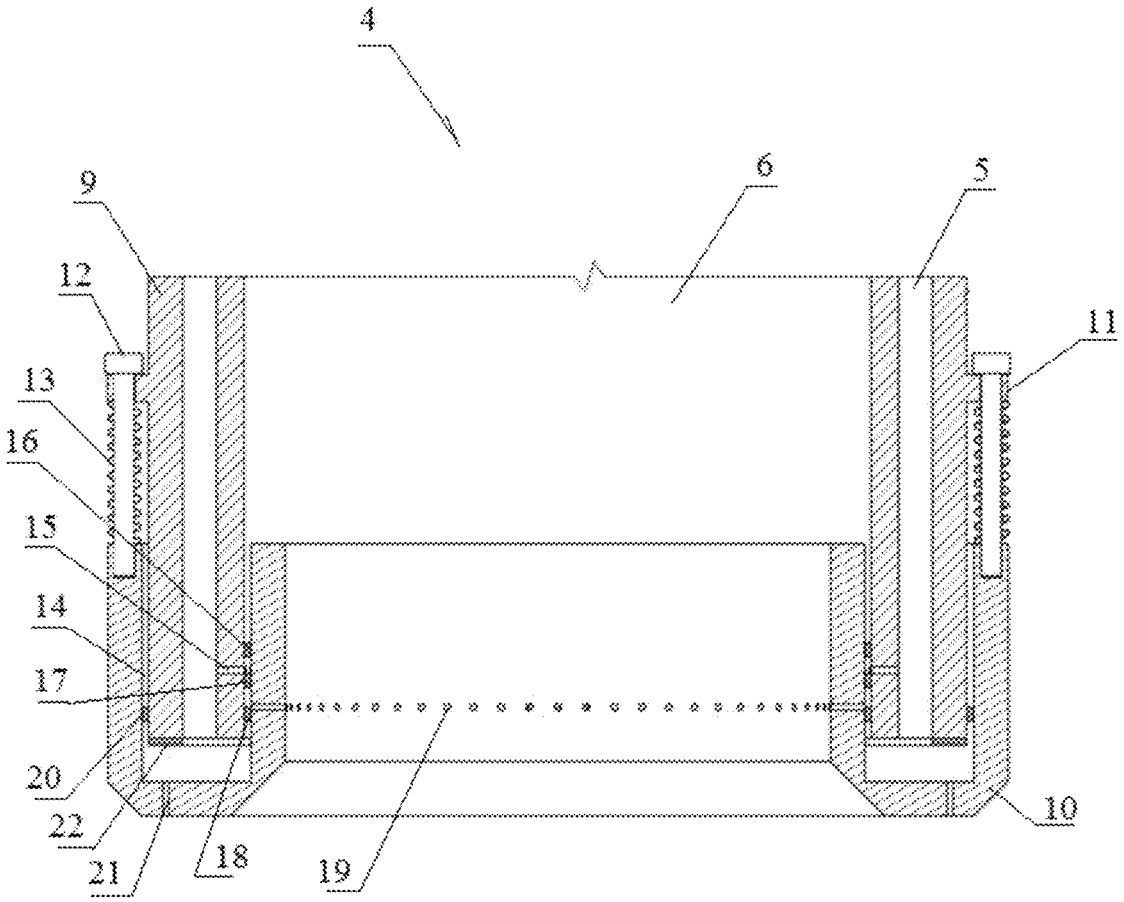
FIG. 2 is a sectional view of a ring-shaped drill bit when the drilling tool of the present invention is in the drilling state.
Figure 3:
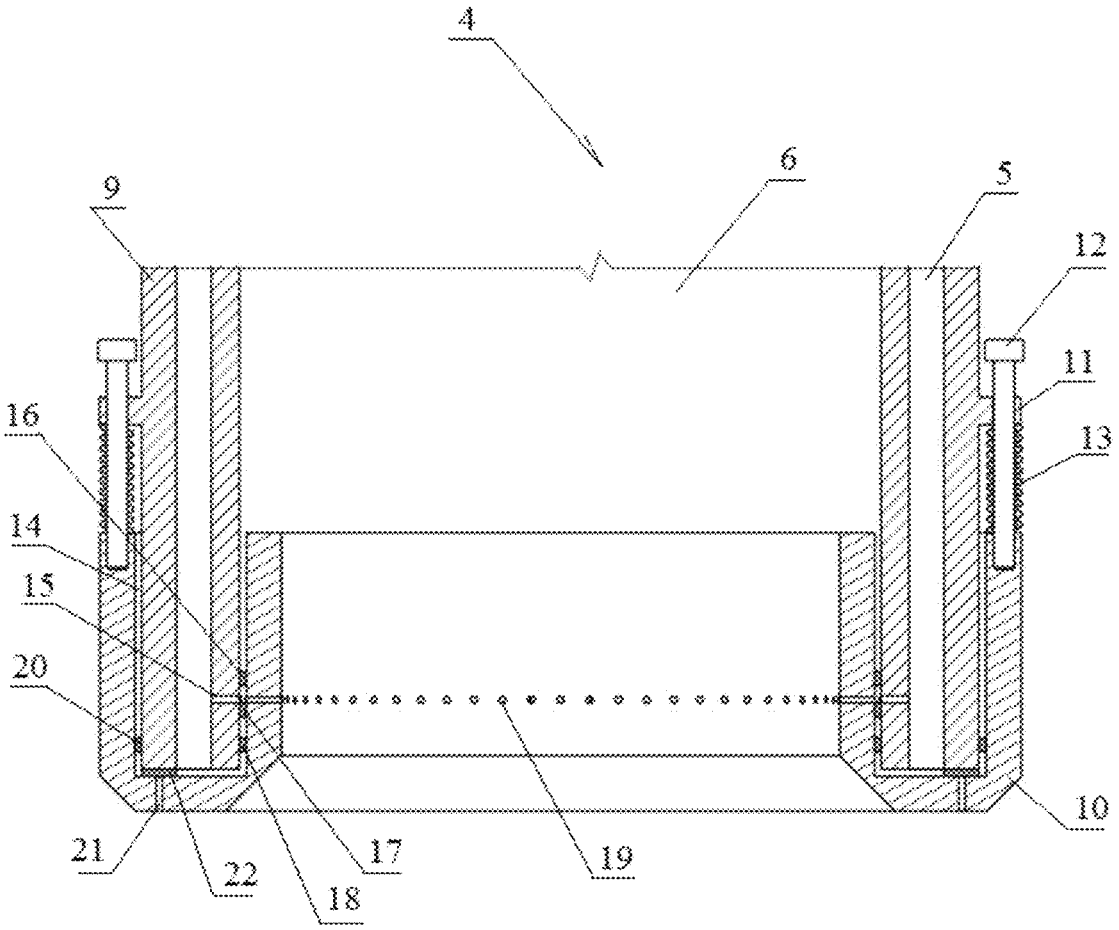
FIG. 3 is a sectional view of a ring-shaped drill bit when the drilling tool of the present invention is in the coring state.

Please refer to FIG. 1 to FIG. 3.

The rapid assembly and automatic sampling drilling tool for frozen soil layer exploration provided in the present invention includes a fixed flow divider 1, a flow guide pipe 2, a coring pipe 3 and a drill bit 4. The fixed flow divider 1 is connected to the drill bit 4 through the flow guide pipe 2 and the coring pipe 3, the flow guide pipe 2 and the coring pipe 3 are mounted between the fixed flow divider 1 and the drill bit 4, two ends of the flow guide pipe 2 are in communication with the fixed flow divider 1 and a main flow channel 5 in the drill bit 4 respectively, hot water in the fixed flow divider 1 can be conveyed into the drill bit 4 through the flow guide pipe 2 and sprayed from a nozzle arranged on the drill bit 4 for drilling and coring operations, an inlet of the coring pipe 3 is in communication with a coring channel 6 in an inner cavity in the middle of the drill bit 4, and a core sample drilled by the drill bit 4 is taken out through the coring pipe 3.

The coring pipe 3 is a plexiglass pipe, four flow guide pipes 2 are provided, and the four flow guide pipes 2 are arranged around the coring pipe 3, the flow guide pipes 2 are connected to the drill bit 4 by a quick connector 7, and the flow guide pipes 2 and the drill bit 4 can be quickly disassembled through the quick connector 7, and a breaker 8 is mounted at a junction between the drill bit 4 and the inlet of the coring pipe 3 for breaking the core sample drilled by the drill bit 4.

The drill bit 4 is a ring structure, the drill bit 4 is composed of an inner ring 9 and an outer ring 10, the outer ring 10 is sleeved on the lower part of the inner ring 9, the top of the inner ring 9 is equipped with a male end of the quick connector 7, and the top of the inner ring 9 can be fixedly connected with a female end of the quick connector 7 assembled at the bottom of the flow guide pipe 2 through the male end of the quick connector 7, a plurality of connecting ear plates 11 are arranged around the lower part of the inner ring 9, positioning bolts 12 are arranged on the connecting ear plates 11 in a penetrating manner, the inner ring 9 is connected to the outer ring 10 through the positioning bolts 12, a reset spring 13 is sleeved on the positioning bolts 12 below the connecting ear plates 11, and the outer ring 10 can move along the axial direction of the positioning bolts 12 as the reset spring 13 extends and retracts.

Both the inner ring 9 and the outer ring 10 are hollow structures, the inner cavities of the outer ring 10 and the inner ring 9 are set as coring channels 16, a circulation channel 14 is formed between the outer wall and the bottom of the inner ring 9 and the inner wall and the bottom of the outer ring 10, a vertical main flow channel 5 is formed in the side wall of the inner ring 9, an inlet at the upper end of the main flow channel 5 is in communication with an outlet of the flow guide pipe 2, the main flow channel 5 is used as a passage of hot water in the fixed flow divider 1; an outlet at the bottom of the main flow channel 5 is in communication with the circulation channel 14 formed between the inner ring 9 and the outer ring 10, a water supply nozzle 15 is provided on the side wall of the main flow channel 5 corresponding to the inner cavity of the inner ring 9, and two ends of the water supply nozzle 15 are in communication with the main flow channel 5 and the circulation channel 14 respectively; a first seal ring 16 is mounted on the upper part of the water supply nozzle 15 in the circulation channel 14, a second seal ring 17 and a third seal ring 18 are mounted sequentially on the lower part of the water supply nozzle 15 in the circulation channel 14, a plurality of coring nozzles 19 are provided around the side wall of the outer ring 10 between the first seal ring 16 and the third seal ring 18; and the coring nozzles 19 can be in communication with the water supply nozzle 15 through the circulation channel 14, a fourth seal ring 20 is mounted in the other side of the circulation channel 14 corresponding to the third seal ring 18, a drilling nozzle 21 is provided at the bottom of the outer ring 10, a fifth seal ring 22 is mounted at the bottom of the inner ring 9, and the fifth seal ring 22 is arranged corresponding to the drilling nozzle 21; when the outer ring 10 moves to the farthest end for drilling operation under the action of gravity and the tension of the reset spring 13, the first seal ring 16, the second seal ring 17, the third seal ring 18 and the fourth seal ring 20 seal the passage between the water supply nozzle 15 and the coring nozzle 19 and the main flow channel 5 and the circulation channel 14 respectively, so that the hot water in the main flow channel 5 is sprayed through the drilling nozzle 21 for drilling operation; when coring to the set position, the outer ring 10 moves up and fits tightly against the bottom of the inner ring 9, the first seal ring 16, the second seal ring 17, the third seal ring 18 and the fourth seal ring 20 seal the circulation channel 14, the fifth seal ring 22 seals the drilling nozzle 21, the water supply nozzle 15 is in communication with the coring nozzle 19 through the circulation channel 14, and the hot water in the main flow channel 5 is sprayed through the coring nozzle 19 for coring operation.

The fixed flow divider 1, the quick connector 7 and the breaker 8 are all assemblies of existing equipment, so the specific models and specifications are not described in detail.

The working principle of the present invention is as follows:

When the rapid assembly and automatic sampling drilling tool for frozen soil layer exploration provided by the present invention starts drilling, the drilling tool is lowered vertically to the borehole, and the outer ring 10 of the drill bit 4 moves to the farthest end under the action of gravity and the tension of the reset spring 13 to form a drilling state. In this state, hot water enters from the inlet of the fixed flow divider 1, flows through the flow guide pipe 2, and then merges in the main flow channel 5 in the side wall of the inner ring 9 of the drill bit 4. At this time, the first seal ring 16 and the second seal ring 17 seal the water flow channel of the water supply nozzle 15, the third seal ring 18 seals the water flow channel of the coring nozzle 19, and the fourth seal ring 20 seals the circulation channel 14 between the inner ring 9 and the outer ring 10; hot water is sprayed from the drilling nozzle 21 at the bottom of the outer ring 10 to melt the frozen soil layer for drilling, and the formed core samples enter the coring pipe 3.

As drilling progresses, the coring pipe 3 is filled with core samples gradually; at this time, the drill bit is lowered continuously, and the outer ring 10 of the drill bit 4 begins to contact the bottom of the borehole. Under the thrust of the frozen soil layer at the bottom of the borehole, the outer ring 10 overcomes gravity and the tension of the reset spring 13; the outer ring 10 moves upward to be close to the bottom of the inner ring 9, forming a coring state. In this state, the water supply nozzle 5 formed on the side wall of the inner ring 9 is in communication with the coring nozzle 19 formed on the side wall of the outer ring 10 through the circulation channel 14. The first seal ring 16, the second seal ring 17, the third seal ring 18 and the fourth seal ring 20 seal the circulation channel 14 between the inner ring 9 and the outer ring 10, and the fifth seal ring 22 seals the drilling nozzle 21 at the bottom of the outer ring 10. At this time, hot water can flow from the water supply nozzle 15 on the side wall of the inner ring 9 into the coring nozzle 19 on the side wall of the outer ring 10, which is sprayed to melt the core samples radially until the core samples are melted off.

After the core samples are melted off, the drilling tool is pulled up; core samples are supported by the breaker 8 on the drill bit 4 and moved to the earth surface along with the drilling tool; at this time, the quick connector 7 is manually opened, the drill bit 4 can be quickly removed, the coring pipe 3 containing the core samples is pulled out, and the core samples are recovered, and one round of drilling is completed. The coring pipe 3 is cleaned and placed in the space surrounded by the flow guide pipe 2. Then the male and female ends of the quick connector 7 are closed, the drill bit 4 is connected with the flow guide pipe 2, and the coring pipe 3 is fixed again to start the second drilling.

The invention claimed is:

1. A rapid assembly and automatic sampling drilling tool for frozen soil layer exploration, comprising a fixed flow divider, a flow guide pipe, a coring pipe and a drill bit, wherein the fixed flow divider is connected to the drill bit through the flow guide pipe and the coring pipe, the flow guide pipe and the coring pipe are mounted between the fixed flow divider and the drill bit, two ends of the flow guide pipe are in communication with the fixed flow divider and a main flow channel in the drill bit respectively, hot water in the fixed flow divider can be conveyed into the drill bit through the flow guide pipe and sprayed from a nozzle arranged on the drill bit for drilling and coring operations, an inlet of the coring pipe is in communication with a coring channel in an inner cavity in a middle of the drill bit, and a core sample drilled by the drill bit is taken out through the coring pipe, wherein the coring pipe is a plexiglass pipe, four of the flow guide pipes are provided, and the four flow guide pipes are arranged around the coring pipe, the flow guide pipes are connected to the drill bit by a quick connector, and the flow guide pipes and the drill bit can be quickly disassembled through the quick connector, and a breaker is mounted at a junction between the drill bit and the inlet of the coring pipe for breaking the core sample drilled by the drill bit.

2. The rapid assembly and automatic sampling drilling tool for frozen soil layer exploration according to claim 1, wherein the drill bit is a ring structure, the drill bit is composed of an inner ring and an outer ring, the outer ring is sleeved on the lower part of the inner ring, the top of the inner ring is equipped with a male end of the quick connector, and the top of the inner ring can be fixedly connected with a female end of the quick connector assembled at the bottom of the flow guide pipe through the male end of the quick connector, a plurality of connecting ear plates are arranged around the lower part of the inner ring, positioning bolts are arranged on the connecting ear plates in a penetrating manner, the inner ring is connected to the outer ring through the positioning bolts, a reset spring is sleeved on the positioning bolts below the connecting ear plates, and the outer ring can move along the axial direction of the positioning bolts as the reset spring extends and retracts.

3. The rapid assembly and automatic sampling drilling tool for frozen soil layer exploration according to claim 2, wherein both the inner ring and the outer ring are hollow structures, the inner cavities of the outer ring and the inner ring are set as coring channels, a circulation channel is formed between an outer wall and a bottom of the inner ring and an inner wall and a bottom of the outer ring, a vertical main flow channel is formed in a side wall of the inner ring, an inlet at an upper end of the main flow channel is in communication with an outlet of the flow guide pipe, the main flow channel is used as a passage for hot water from the fixed flow divider, an outlet at a bottom of the main flow channel is in communication with the circulation channel formed between the inner ring and the outer ring, a water supply nozzle is provided on a side wall of the main flow channel corresponding to the inner cavity of the inner ring, and two ends of the water supply nozzle are in communication with the main flow channel and the circulation channel respectively, a first seal ring is mounted above the water supply nozzle in the circulation channel, a second seal ring and a third seal ring are mounted below the water supply nozzle in the circulation channel, a plurality of coring nozzles are provided around a side wall of the outer ring between the first seal ring and the third seal ring, and the coring nozzles can be in communication with the water supply nozzle through the circulation channel, a fourth seal ring is mounted on an opposite side of the circulation channel from the third seal ring, a drilling nozzle is provided at the bottom of the outer ring, a fifth seal ring is mounted at the bottom of the inner ring, and the fifth seal ring is arranged below the drilling nozzle, when the outer ring moves to a farthest end for drilling operation under the action of gravity and the tension of the reset spring, the first seal ring, the second seal ring, the third seal ring and the fourth seal ring seal the passage between the water supply nozzle and the coring nozzle and the main flow channel and the circulation channel respectively so that the hot water in the main flow channel is sprayed through the drilling nozzle for drilling operation; and when coring, the outer ring moves up and fits tightly against the bottom of the inner ring, and the first seal ring, the second seal ring, the third seal ring and the fourth seal ring seal the circulation channel, the fifth seal ring seals the drilling nozzle, the water supply nozzle is in communication with the coring nozzle through the circulation channel, and the hot water in the main flow channel is sprayed through the coring nozzle for coring operation.

* * * * *